US006000269A

United States Patent [19]

Kataoka

[11] Patent Number: 6,000,269

[45] Date of Patent: Dec. 14, 1999

[54] METHOD OF FORGING AND FORGING EQUIPMENT

[76] Inventor: Tetsuji Kataoka, 36-3 Nishifunatsu, Fuji-shi, Shizuoka-ken, Japan

[21] Appl. No.: 09/063,252

[22] Filed: Apr. 20, 1998

[51] Int. Cl.[6] ..... B21J 13/02

[52] U.S. Cl. ..... 72/352; 72/272

[58] Field of Search ..... 72/253.1, 272, 72/352, 359, 377

[56] References Cited

U.S. PATENT DOCUMENTS 3,068,515 12/1962 Thomas ..... 72/253.1

FOREIGN PATENT DOCUMENTS 535976 11/1976 U.S.S.R. ..... 72/272

1002900 9/1965 United Kingdom ..... 72/272

*Primary Examiner*—Lowell A. Larson
*Attorney, Agent, or Firm*—Lyon & Lyon LLP

[57] ABSTRACT

Forging equipment and techniques prevent damage to the die set while also preventing abnormal flow of the material used in the forging process. In one embodiment, the forging equipment comprises a die set with a holding portion, constructed separate from the guiding portion. The holding portion is configured to accommodate the workpiece material and the punch portion as it is dropped down on the workpiece. At the comer where the holding portion and the guiding portion meet, the holding portion forms a retaining cavity, which has a sufficient size to accommodate a metal sealing assembly. The metal sealing assembly at one end terminates in an angled material contacting surface that prevents formation of cracks and abnormal flow of material away from its intended path of flow.

9 Claims, 4 Drawing Sheets

METHOD OF FORGING AND FORGING EQUIPMENT

BACKGROUND OF THE INVENTION

Field of the Invention

The field of the present invention is forging metallic or other suitable materials in accordance with cold, warm, or hot forging operations.

Background

As is well known, forging is a process by which a product is formed from a metallic or other suitable materials into a particular or desired shape. During the forging process, metallic materials, such as aluminum, may be subjected to conventional cold, warm, or hot forging operations to force the materials to assume a particular shape.

Although there are many different forging techniques, one particular type utilizes a die set including a holding portion, within which a workpiece is disposed. A punching portion of the die set is dropped down to press against the workpiece and force it to flow into a guiding portion of the die set and to assume a particular shape within the guiding portion. During this type of conventional forging process, the die set suffers damage. Also, there is stagnant buildup of dead material from abnormal flow of material.

FIG. 1*a* further illustrates the manner in which such a conventional forging process can generate damaging cracks. A workpiece W is disposed within the holding portion 4'(2') of the die set 2', which is integrally formed with the guiding portion 5'(2') of the die set 2' as a single unit. The punching portion 3'(2') is pressed against the workpiece W to accelerate the plastic deformation phase of the workpiece. This exerts extreme pressure on the die set 2'. As the workpiece W is pressed down, the portion of it that contacts an area of the guiding portion 5'(2'), as indicated by reference letter W1, pushes downward in the direction of the pressing action, as illustrated by the vertical arrows in Figure la. At the same time, the portion of the workpiece that contacts the wall of the holding die 4'(2'), as indicated by reference letter W2 pushes outward, exerting pressure on the holding die 4'(2') in a direction illustrated by the horizontal arrows in FIG. 1*a*. Consequently, at the corner C where the holding portion 4'(2') transitions into the guiding portion 5'(2'), forces are simultaneously exerted in two different directions, perpendicular to each other. The diverging forces at the corner C in this integrally formed configuration cause the die set 2' to tear and cracks to occur at the corner C. When such cracks occur, the die set 2' is damaged and rendered ineffective, requiring replacement.

To overcome this problem, in another configuration, the holding portion 4'(2') and the guiding portion of the die set are formed separately. Such a configuration is illustrated in FIG. 1*b*. This configuration is further reinforced from the outside to resist cracks. While this configuration, addressed the problem of alleviating the forces at the corner C that caused the cracks, it gave rise to yet other problems. For instance, as the punch die 3' presses down on the workpiece, there is a tendency for the workpiece material under pressure to escape into any space or clearance that may exist between the holding die 4' and the guiding die 5'. The material slipping into the clearance between the holding die 4' and guiding die 5' results in the formation of burrs. Gradually, with time and usage, the seepage increases, causing buildup of dead material that serves as a wedge, prying the holding die 4' away from the guiding die 5'. Additionally, the formation of burrs destroys the layer of lubricant that is applied on the workpiece prior to commencing the forging process. Once the lubricant is destroyed, the material is further obstructed from flowing along its intended path down into the guiding portion 5'.

In addition, as the workpiece W presses down along the inner walls of the holding die 4', material collects at the corner E where the holding die 4' and the guiding die 5' meet. The arrows in Figure lb illustrate the sluggish and abnormal flow patterns along the corner E, resulting in buildup of material at that location that ultimately remains there and stagnates. The stagnant material is essentially dead metal (indicated by reference numeral D) that prevents products from forming properly.

In a further attempt to address this problem and to prevent the buildup of dead material, the guiding die 5' is curved at the corner E, to provide a rounded surface, instead of sharp corners where the dead metal D once remained. But again, such a configuration not only resulted in the same problem where burrs occur, but, the same bidirectional forces at the curved portion also resulted, causing cracks.

SUMMARY OF THE INVENTION

The present invention relates to improved equipment and forging techniques that prevent damage to the die set while also preventing abnormal flow of the particular workpiece material used in the forging process.

According to a first separate aspect of the present invention, the forging equipment comprises a die set with a holding portion, constructed separate from the guiding portion. The holding portion is configured to accommodate the workpiece material and the punch portion as it is dropped down on the workpiece. At the corner where the holding portion and the guiding portion meet, the holding portion has a cavity formed in it that serves as a retaining cavity or cavity, which is sized to accommodate a metal sealing assembly.

In a second separate aspect, the metal sealing assembly of the first aspect has a horizontal body that slides into the retaining cavity formed within the holding portion. The body of the metal sealing assembly terminates at one end in a tapered head portion. The tapered head portion, at its upper end, abuts the inner wall of the holding die such that the workpiece material, when under pressure, is prevented from escaping into the retaining cavity. From its upper end to its lower end, the tapered head portion provides an angled surface that serves to guide the workpiece material. This surface, upon contacting the workpiece material, serves not only to guide it, but to guide it smoothly, along its intended path toward the center of the guiding die. By configuring the metal sealing assembly in this fashion, the bidirectional forces at the corner between the holding die and the guiding die of the die set are alleviated, as is the buildup of dead material at that location.

In a third separate aspect of the present invention, the upper end of the tapered portion forming the material guiding surface of the second aspect abuts an inner wall of the holding die above the retaining cavity. With such a configuration, even though the workpiece material exerts tremendous pressure in an outward direction on the metal sealing assembly, it cannot encroach into the holding die. If anything, the greater the forces against the metal sealing assembly, the more securely it adheres to the surface of the holding die and the guiding die.

In a fourth separate aspect, the body of the metal sealing assembly accommodated within the retaining cavity of the first aspect is sized to complement the size of the opening defined within the retaining cavity such that the body is forced into the retaining cavity with pressure. By this configuration, material is effectively prevented from migrating into any clearance between the holding die and the guiding die.

In a fifth separate aspect, the holding portion of the first aspect comprises a recessed area or cavity to accommodate the upper end of a tapered head portion of the metal sealing assembly. This feature prevents damage to the metal sealing assembly.

In a sixth separate aspect of the present invention, various combinations of the foregoing separate aspects are contemplated to provide system advantage.

Accordingly, it is an object of the present invention to provide improved forging equipment and methods. Other and further objects and advantages will appear hereinafter.

BRIEF DESCRIPTION OF THE DRAWINGS

In the drawings, which constitute a part of this specification, exemplary embodiments of the forgoing equipment and techniques are illustrated.

DETAILED DESCRIPTION OF THE PREFERRED EMBODIMENTS

Figure 1A:
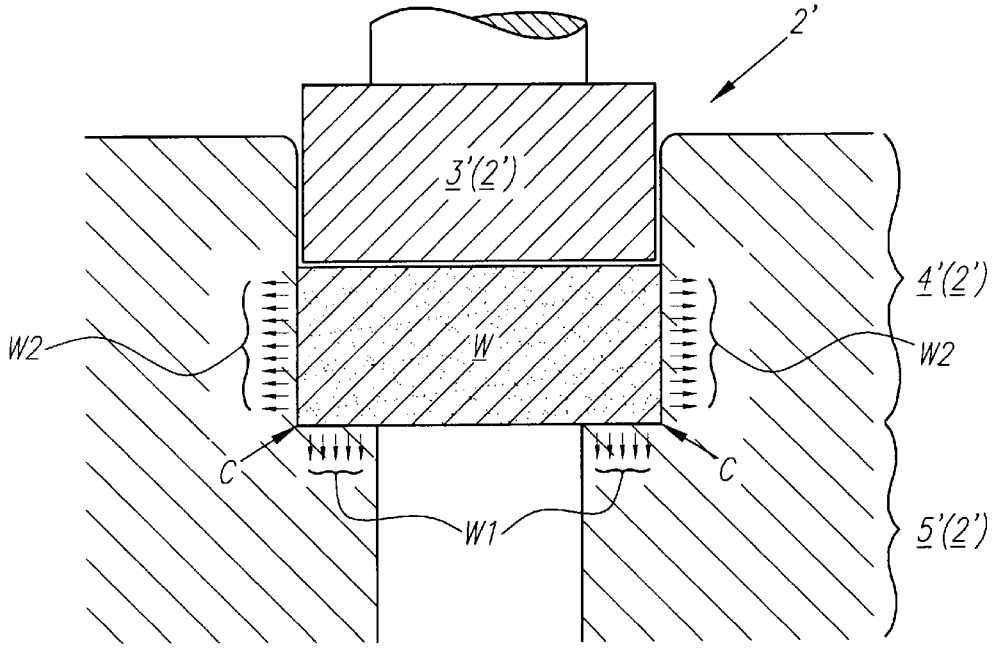
FIG. 1*a* illustrates a cross sectional view of conventional forging equipment, illustrating a problem that occurs during a forging technique using this type of equipment.
Figure 1B:
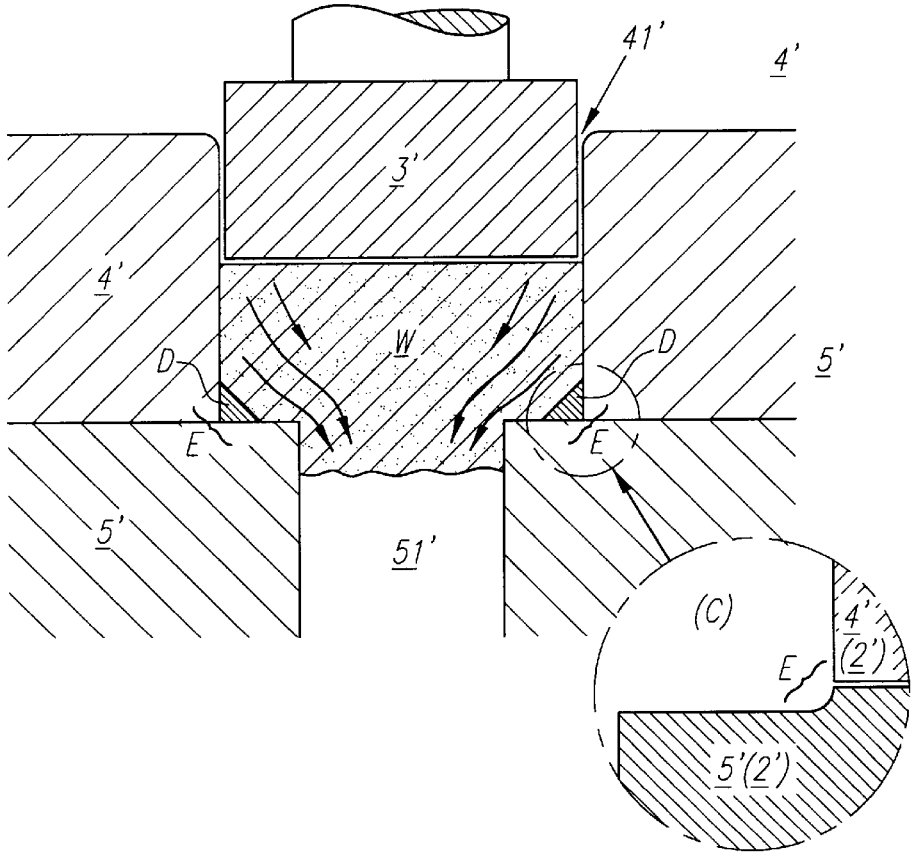
FIG. 1*b* illustrates a cross sectional view of other conventional forging equipment, illustrating yet another problem with a forging technique using this type of equipment.
Figure 2A:
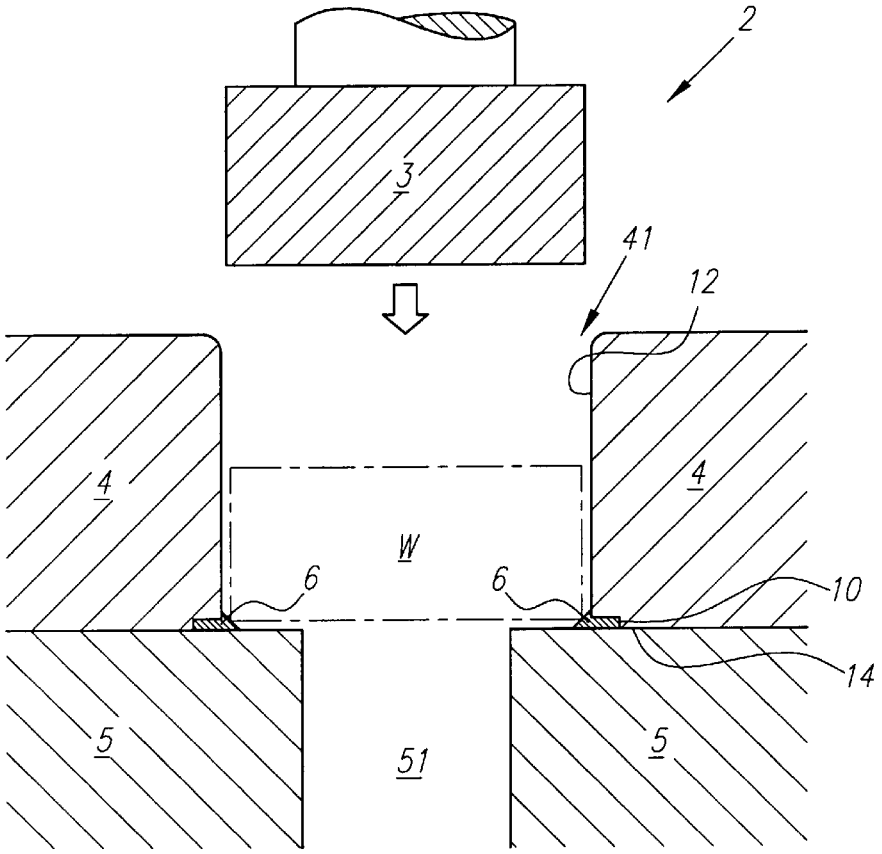
FIG. 2*a* illustrates a cross sectional view of forging equipment with a metal sealing assembly.
Figure 2B:
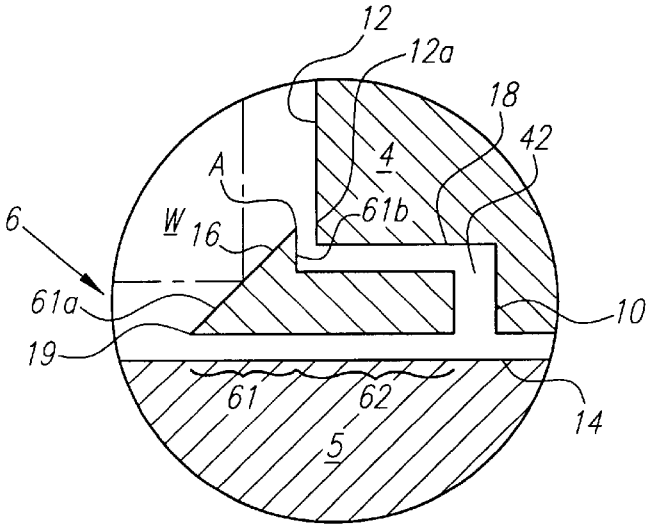
FIG. 2*b* is an enlarged cross sectional detail view illustrating the metal sealing assembly.

FIG. 2 illustrates improved forging equipment and an improved method of forging. The improved forging equipment and method may be used to forge products from suitable materials such as aluminum. The forging equipment comprises, and the forging method utilizes; a die set 2 to form the workpiece W. The die set 2 comprises a holding portion or die 4 configured to hold the workpiece W. A punching portion or die 3 is dropped down on the workpiece W to apply pressure on it and force it through a plastic deformation phase until it assumes a desired shape. The desired shape is determined by a guiding portion or die 5 that restricts workpiece W within its bounds to assume the desired shape for the particular product being manufactured. At a corner along the line where the holding die 4 and the guiding die 5 meet, a metal sealing piece 6 is assembled within a retaining cavity 42 formed within the holding die 4. The metal sealing piece 6 is otherwise referred to as a metal sealing assembly 6.

The punch die 3 is more or less cylindrical in shape and is constructed to ascend and descend freely in an up and down motion. During the forging process, the punch die 3 is pressed or dropped down from above, and gradually travels through the holding die 4 as it applies pressure on the workpiece W. As it travels down farther into the holding die 4, it applies increasing pressure on the workpiece W, which is then forced into the guiding die 5.

The holding die 4 defines a retaining cavity 41 that holds the workpiece W. The retaining cavity 41 prevents the workpiece W from expanding outwardly when the workpiece W is subjected to pressure. As is better illustrated in FIG. 2(*b*), the holding die 4, at its lower extremity 10, comprises a retaining cavity or area 42 where an inner wall 12 substantially contacts (or is otherwise closely aligned proximate) an upper extremity 14 of the guiding die 5. The metal sealing assembly 6 is accommodated within the retaining cavity 42.

Figure 3:
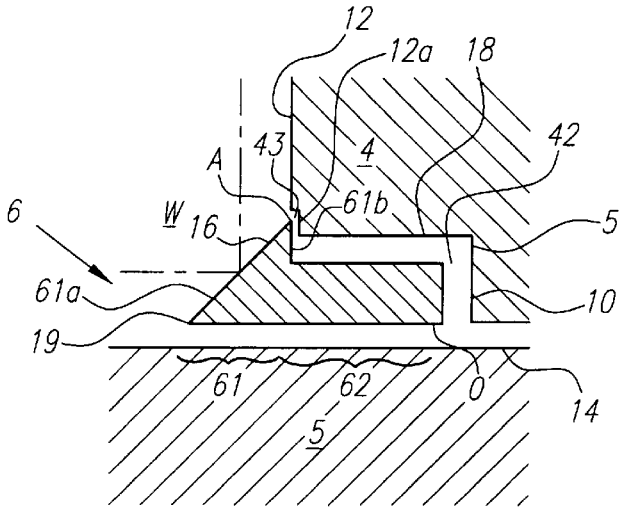
FIG. 3 illustrates a cross sectional view of the metal sealing assembly and the holding die in accordance with a second embodiment.

Referring now to FIG. 3, in accordance with one embodiment of the present invention, to prevent damage to an upper edge 16 of the metal sealing assembly 6, the retaining cavity 42, in its upper wall 18, defines a recessed area or contacting surface retaining cavity 43 for accommodating the upper edge 16.

Referring again to FIG. 2*a*, the guiding die 5 forces the material in its pressurized state to travel through its center. The guiding die 5 defines a forming area 51 where the workpiece W undergoes plastic deformation and assumes the desired shape required for the particular product being manufactured. In the embodiment illustrated in these drawings, the forming area 51 is cylindrical in shape for purposes of forming cylindrical products. It should be recognized, however, that depending on the particular shapes desired, the forming area 51 is appropriately configured. Also, one or more holes in the product may be created as required, as the product is being formed.

Figure 4A:
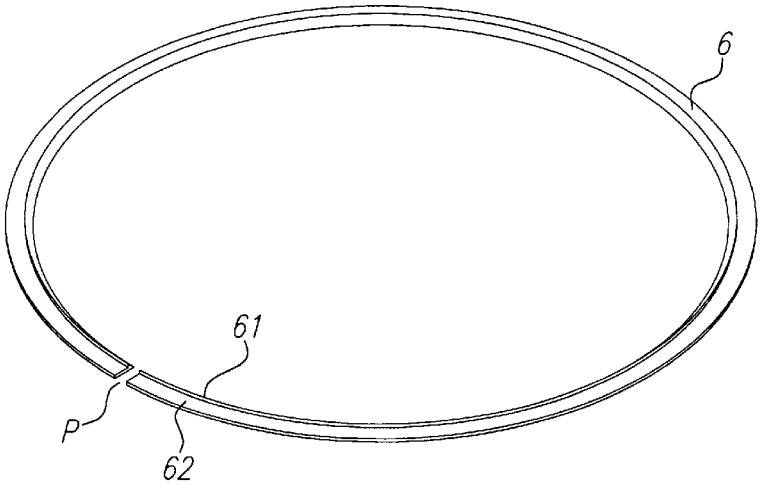
FIG. 4*a* illustrates an exploded perspective view of the metal sealing assembly.
Figure 4B:
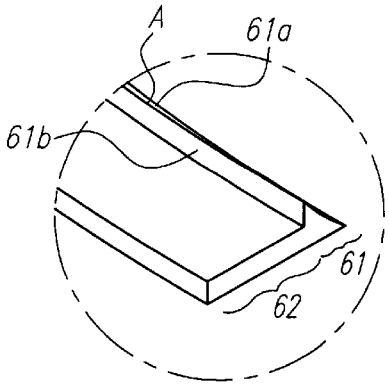
FIG. 4*b* illustrates an enlarged detail view of the metal sealing assembly of FIG. 4(*a*).

Referring now to FIG. 4(*a*), the metal sealing assembly 6, as illustrated, is configured in a circular ring-like shape, similar to the shape of the holding die 4. Once engaged within the retaining cavity 42 of the holding die 4, the metal sealing assembly 6 conforms along the inner circumference of the holding die 4.

Referring now to FIGS. 2, 3, and 4(*b*), the metal sealing assembly comprises a material guiding head section 61, somewhat triangular in shape (FIG. 4(*b*)), and a flange portion 62, somewhat rectangular (FIG. 4(*b*)) in shape. The flange portion 62 is press fit into the retaining cavity 42 by force applied by the workpiece material. To facilitate this action, the outer extremities of the flange portion 62 conform to the inner extremities of the retaining cavity 42. It should be noted that in the drawings, the clearance areas or spaces between the outer extremities of the flange portion 62 and the inner extremities of the retaining cavity 42 are somewhat exaggerated for illustration purposes. The material guiding head section 61 is wider and extends beyond the retaining cavity 42 to guide the workpiece W during the forging process.

The material guiding head section 61 has a material guiding surface 61*a* tapered from the upper edge 16 to a lower edge 19. The tapered configuration of the material guiding section 61, during the forging process, urges the material to flow smoothly toward a forming area 51 defined within the guiding die 5. The material guiding head section 61, opposite the material guiding surface 61*a*, comprises a peripheral wall contacting surface 61*b* that contacts or abuts the inner wall 12 or an area 12*a* of the inner wall 12, of the holding die 4.

The material guiding surface 61*a* contacts the workpiece W in its pressurized state and guides the workpiece material toward the guiding die 5. Referring particularly to FIGS. 2(*b*) and 3, the material guiding surface 61*a* abuts an area 12*a* of the inner wall 12 directly above the opening of the retaining cavity 42. In order to make the material flow smoothly, the material guiding surface 61*a* may be curved as better shown in FIG. 4(*b*).

The peripheral wall contacting surface 61*b* is configured to lie substantially perpendicular to the adjoining edge A of the material guiding surface 61*a*. Similar to the upper tip of the material guiding surface 61*a*, the peripheral wall contacting surface 61*b* contacts or abuts an area 12*a* of the inner wall 12 directly above the opening of the retaining cavity 42. With this configuration, despite extreme pressure exerted by the workpiece W in its pressurized state, the metal sealing assembly 6 resists being forced into any clearance areas between the holding die 4 and the guiding die 5. Therefore, the material guiding surface 61*a* always maintains its position, protruding beyond the retaining cavity 42.

The flange portion 62 projects horizontally outward from the material guiding head section 61. The body of the flange portion 62 is press fit into the retaining cavity 42 with pressure from the workpiece material applied against the material guiding surface 61*a*. The flange portion 62 is configured to minimize any clearance areas or spaces between its outer exterior O and the inner peripheral surface S of the retaining cavity 42. The pressurized material subjects tremendous outward pressure on the metal sealing assembly 6, therefore, minimizing the clearance is essential for an effective sealing arrangement. In accordance with one embodiment, a portion of the metal sealing assembly 6 may be severed, as illustrated at P in FIG. 4(*a*), to further assist the metal sealing assembly to absorb the outward forces. By severing the metal sealing assembly 6, it is designed to gradually give way and open when subjected to extreme pressure. Also, it should be recognized that although the metal sealing assembly 6 is shown as circular in shape in the illustrated embodiment, it may be variously shaped, depending on the shape of the holding die 4 and the desired product. For example, it may be rectangular, oval, etc. Also, in accordance with an alternative embodiment, if the metal sealing assembly 6 is configured to provide larger material guiding surfaces, depending on the product to be formed, it may not be necessary to provide the flange portion 62. Various other configurations may be possible along the principles of the embodiments explained here.

Figure 5:
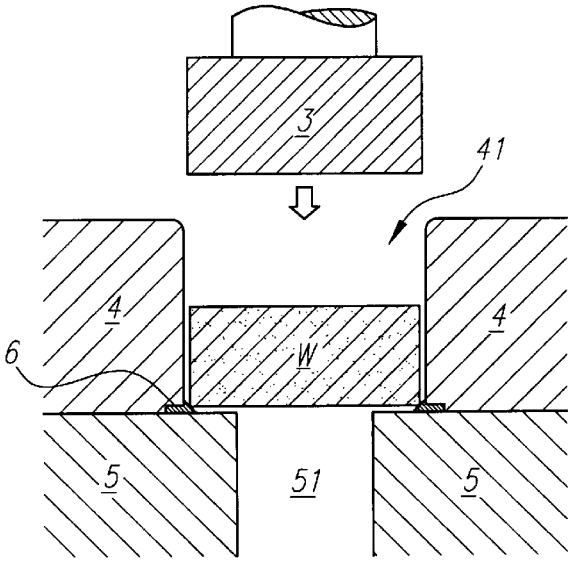
FIG. 5 is a cross sectional view illustrating, in conjunction with enlarged detail views shown in FIGS. 5(*a*), 5(*b*), and 5(*c*), a forging sequence.
Figure 5A:
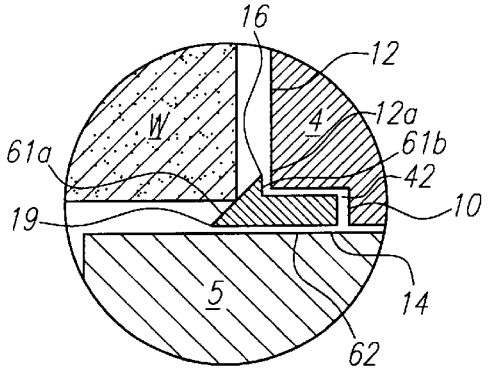
Figure 5B:
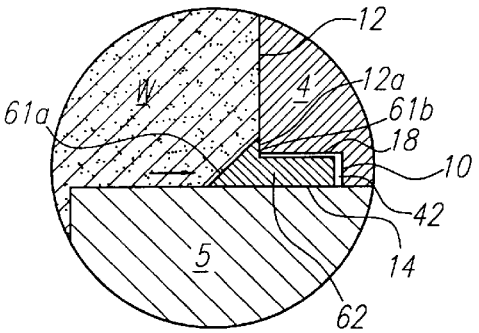

Referring now to FIG. 5, the method of forging is described, of course, using the forging equipment described above. FIG. 5 shows the punch portion 3 disposed directly above the workpiece W that is held within the holding die 4. Operation begins with the punch die 3 in this position. Referring now to FIG. 5*a*, at this stage of operation, when disposed within the holding die 4, the workpiece W contacts the material guiding surface 61*a*. As the punch die 3 is pressed against the workpiece W, it in turn presses against the material guiding surface 61*a* of the metal sealing assembly 6 and forces its flange portion 62 into the retaining cavity 42. With increasing pressure, the workpiece W is compressed gradually, which causes it to deform into a mass of pressurized material. The pressurized material exerts outward pressure on all neighboring objects and ultimately exerts pressure on the angled surface of the material guiding surface 61*a* that lies in contact with the workpiece W. Because of the angled configuration of the material guiding surface 61*a* of the metal sealing assembly 6 and support provided for it along its bottom surface, by the guiding die 5, the metal sealing assembly 6 is pushed outward along a horizontal axis. Due to the forces acting as they do, the metal sealing assembly 6 is pressed against the inner wall 12 of the holding die 4 such that the peripheral wall contacting surface 61*b* abuts an area 12*a* of the inner wall 12 of the holding die 4. This operation is illustrated in FIG. 5(*b*).

Despite the pressure forcing the metal sealing assembly 6 against the inner wall 12 as it does, no portion of the metal sealing assembly will slip through spaces between the metal sealing assembly 6 and the holding die 4. Moreover, the material guiding surface 61*a*, maintains its position, protruding beyond the retaining cavity. Continuous pressure against the material guiding surface 61*a*, forces the metal sealing assembly 6 toward the inner wall 12 until the metal sealing assembly 6 adheres closely to the inner wall 12. This eliminates materials from slipping into any space or clearance between the holding die 4 and the guiding die 5, thereby preventing any burrs from forming. Moreover, in the embodiment with a contacting surface retaining cavity 43, the peripheral contacting surface 61*b* is received in the contacting surface retaining cavity 43 that prevents any damage to the ends of the metal sealing assembly 6. By forming the contacting surface retaining cavity 43 at about the same level as the peripheral wall contacting surface 61*b*, material is prevented from seeking and escaping into any clearance areas. The dimensions of the contacting surface retaining cavity 43 are small enough so that it does not pose a hindrance in ejecting the workpiece W after it is formed.

Figure 5C:
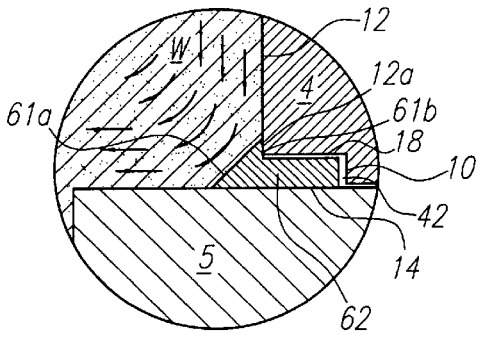

As also illustrated by FIG. 5*c*, the workpiece material in its pressurized state first flows in a direction where it contacts the inner walls of the holding piece 4. At his stage of operation, the material remaining directly above the forming area 51 is pressed down easily into it. The material disposed proximate the inner walls 12 of the holding die 4 is pressed down along the surface of the inner walls 12 until the material is near the corner area between the holding die 4 and the guiding die 5. The material guiding surface 61*a* serves to deflect the material here by approximately 90 degrees, as illustrated by the arrows, directing it toward the center of the guiding die 5. This prevents any buildup of the material at the corner area and serves to guide all the material smoothly along its intended path. A smooth flow of material also prevents unusual forces from resulting that may damage the die set 2.

While the invention is susceptible to various modifications and alternative forms, specific examples of it have been shown by way of example in the drawings and are described here in detail. It should be understood, however, that is not intended to limit the invention to the particular forms disclosed, but on the contrary, the invention is to cover all modifications, equivalents, and alternatives falling within the spirit and scope of the invention as defined by the following claims.

What is claimed is:

1. A method of forging a workpiece into a particular shape using a die set, comprising disposing the workpiece within a holding die;

dropping a punching die to press against the workpiece;

urging the workpiece into a guiding die to confine the workpiece within a specific area defined by the guiding die through a plastic deformation phase;

assembling a metallic sealing piece at an adjoining area between the holding die and the guiding die, the metallic sealing piece configured to provide a guiding surface to contact the workpiece, including locating the metallic sealing piece within a retaining cavity of the holding die formed at the adjoining areas such that one end of the guiding surface abuts an inner wall of the holding die preventing any portion of the workpiece from being lodged within the adjoining area between the holding die and the guiding die; and using the guiding surface of the metallic sealing piece to deflect flow of any portion of the workpiece lodged within the adjoining area between the holding die and the guiding die toward the center of the guiding die.

2. A method of forging according to claim 2, further comprising:

adapting the inner peripheral surface of the holding die to provide a contacting surface located at substantially equal height to an outer contacting surface defined by a peripheral wall of the metallic sealing piece such that the metallic sealing piece is received within the retaining cavity when the workpiece applies pressure on the metallic sealing piece.

3. A method of forging according to claim 1, further comprising:

adapting the holding die to provide a retaining cavity having an inner peripheral contacting surface located at substantially equal height to an outer peripheral contacting surface of the metallic sealing piece such that the metallic sealing piece is received within the retaining cavity when the workpiece applies pressure on the metallic sealing piece.

4. An apparatus of forging a workpiece into a particular shape by applying pressure against the workpiece, comprising a punching die configured to apply pressure against the workpiece;

a holding die configured to hold the workpiece and the punching die as the punching die travels farther down into the holding die;

a guiding die configured to define a cavity, the guiding die contacting the holding die and the holding die having a retaining cavity formed at the guiding die; and a metal sealing piece within the retaining cavity, the metal sealing piece including a guiding surface.

5. An apparatus according to claim 4, the guiding surface of the metal sealing piece being configured at an angle such that the guiding surface at one end abuts an inner wall of the holding die at a location directly above the retaining cavity defined within the holding die.

6. An apparatus according to claim 5, the holding die along a portion of its inner peripheral surface being substantially level with the outer surface of the metal sealing piece that contacts the holding die.

7. An apparatus according to claim 4, the holding die along a portion of its inner peripheral surface being substantially level with the outer surface of the metal sealing piece that contacts the holding die.

8. An apparatus according to claim 4, the holding die including a recess to accommodate an upper end of the guiding surface of the metal sealing piece.

9. An apparatus of forging a workpiece into a particular shape by applying pressure against the workpiece, comprising a punching die configured to apply pressure against the workpiece;

a holding die configured to hold the workpiece and the punching die as the punching die travels farther down into the holding die;

a guiding die configured to define a cavity, the guiding die contacting the holding die and the holding die having a retaining cavity formed at the guiding die; and a metal sealing piece within the retaining cavity, the metal sealing piece including a guiding surface, the metal sealing piece being a split ring, in the relaxed state the split ring being displaced from the inner wall of the retaining cavity.

* * * * *

UNITED STATES PATENT AND TRADEMARK OFFICE

CERTIFICATE OF CORRECTION

PATENT NO. : 6,000,269

DATED : December 14, 1999

INVENTOR(S) : KATAOKA, Tetsuji

It is certified that error appears in the above-identified patent and that said Letters Patent is hereby corrected as shown below:

In claim 2 (col. 7, line 8), delete "2" and insert therefor -- 1 --.

Signed and Sealed this

Seventh Day of November, 2000

*Attest:*

*Attesting Officer*

Q. TODD DICKINSON

*Director of Patents and Trademarks*